United States Patent [19]

Cohen

[11] 4,126,264

[45] Nov. 21, 1978

[54] CARDBOARD CONTAINER

[75] Inventor: Manuel Cohen, Buffalo, N.Y.

[73] Assignee: Wagner Folding Box Corporation, Buffalo, N.Y.

[21] Appl. No.: 827,613

[22] Filed: Aug. 25, 1977

[51] Int. Cl.[2] ..... B65D 5/48; B65D 5/46

[52] U.S. Cl. ..... 229/27; 206/183; 229/28 BC

[58] Field of Search ..... 229/27, 28 BC, 40; 206/434, 183, 184, 188

[56] References Cited

U.S. PATENT DOCUMENTS

| | | | |
|---|---|---|---|
| 2,346,206 | 4/1944 | Broderick | 229/27 |
| 3,040,955 | 6/1962 | Paul | 229/27 |
| 3,056,528 | 10/1962 | Shiels, Jr. | 206/183 |
| 3,677,458 | 7/1972 | Gosling | 229/27 |
| 3,703,982 | 11/1972 | Daughtry | 229/28 |
| 3,780,906 | 12/1973 | Katzenmeyer | 229/28 BC |

*Primary Examiner*—Davis T. Moorhead
*Attorney, Agent, or Firm*—Christel & Bean

[57] ABSTRACT

A disposable carrying case or tote-box is formed from a single cardboard blank to form a pair of longitudinally extending side-by-side compartments. The blank provides a continuous bottom wall, integral side walls extending upwardly from each side edge of the bottom wall integral top walls extending inwardly from the upper edge of each side wall, medial walls extending downwardly from the inner longitudinal edge of each top wall, and terminal flaps at the side edges of the blank which are adhesively secured to the bottom wall. Each of the top walls has portions thereof die cut and scored adjacent to the ends thereof and bent downwardly to form end walls for the two compartments.

4 Claims, 5 Drawing Figures

CARDBOARD CONTAINER

BACKGROUND OF THE INVENTION

This invention relates to cardboard containers which serve as tote-boxes and which are fabricated and shipped in flat folded condition and are readily set up into final form at the point of use.

In hospitals and like establishments it is common to use tote-boxes of metal or plastic. These containers are of course of a more-or-less permanent type and since they are employed for carrying surgical instruments and other medical and hospital supplies it is necessary that they be cleansed frequently. The tote-box of the present invention may merely be discarded after a single use or whenever it is no longer clean and sanitary.

SUMMARY OF THE INVENTION

The tote-box disclosed and claimed herein is formed from a single cardboard blank. A medial portion of the blank provides the bottom wall of the box, and the side portions are bent upwardly, inwardly, and downwardly at the center of the box to provide two side-by-side compartments.

The final downwardly bent portions lie against each other and are formed to provide a handle portion for carrying the box and also include means for retaining the box in its set up condition for use. As initially fabricated the several wall portions lie flat-wise against each other for convenient shipment and storage.

The inwardly bent upper walls of the box are die-cut and scored so that portions thereof are bent downwardly during the setting up operation to provide end walls for the two compartments. This also leaves the tops of the compartments open for placing articles in the compartments and removing them therefrom.

DESCRIPTION OF THE ILLUSTRATED EMBODIMENT

Speaking generally the container of the present invention comprises two rectangular side-by-side compartments with two medial wall portions separating the compartments and with such wall portions including a handle formation. It is believed that the construction of the receptacle of the present invention can best be described by first describing the blank thereof and then describing the several steps employed in fabricating the device into flat folded form and then describing the setting up of the container for actual use.

Figure 1:
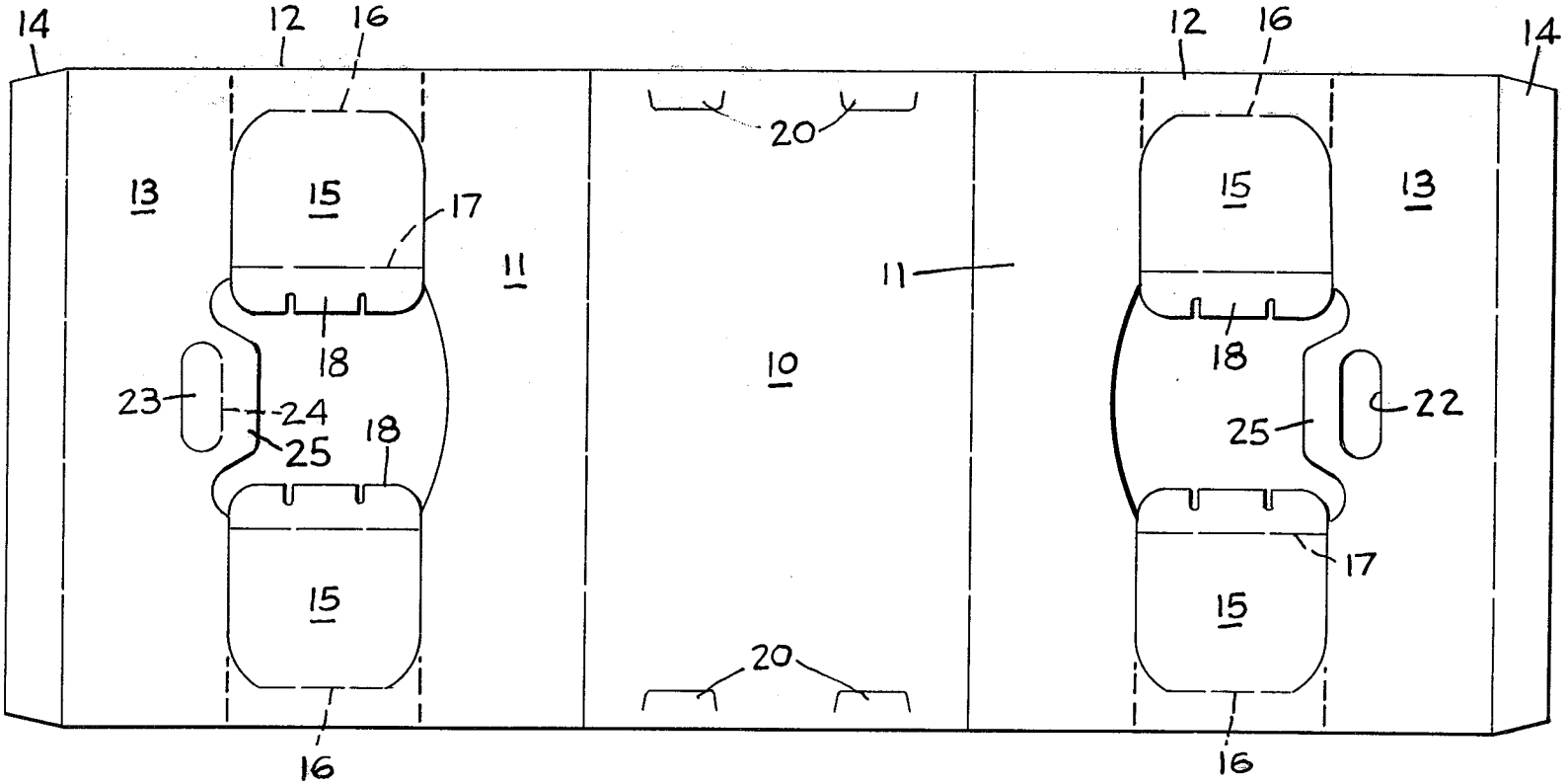
FIG. 1 shows a cardboard blank for use in fabricating one form of the container or tote-box of the present invention.

The blank shown in FIG. 1 is divided by a series of parallel score lines to form a central portion 10 which provides the bottom wall of the two compartments mentioned above, a pair of panel portions 11 at opposite sides of bottom wall 10 which form the outside walls of the two compartments mentioned above, a pair of panel portions 12 which form the upper portions of the two compartments a further pair of panels 13 which together form the medial vertical wall between the two compartments and a pair of end flaps 14.

Figure 2:
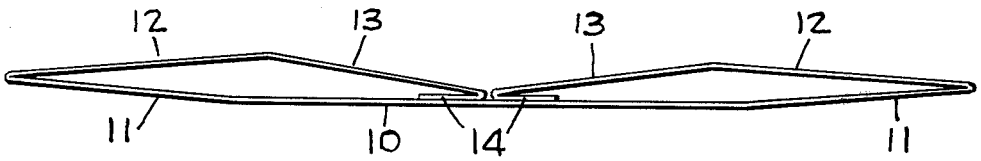
FIG. 2 is an end view of a container formed from the blank shown in FIG. 1 in a preliminary flat folded condition prior to being set up for actual use.

The panels 12 and 13 are folded over the bottom wall 10 and the side wall portions 11 as illustrated in FIG. 2 and the end flaps 14 are adhesively secured to the bottom wall 10. In FIG. 2 the several wall portions are shown slightly separated for clarity of illustration but actually the walls 12 and 13 will lie flat against the walls 10 and 11, this being the condition in which the containers are shipped from the manufacturer to the ultimate user.

Referring again to the blank shown in FIG. 1 the top wall panels 12 provide end walls 15 for each of the two side-by-side compartments. The end walls 15 are die cut about their perimeters excepting for score line portions 16 and are further scored as at 17 to provide connecting flaps 18. The bottom wall 10 is provided with four die cut tabs 20 for cooperation with flaps 18 in a manner which will presently appear. The right hand wall portion 13 as viewed in FIG. 1 has an oblong cutout 22, and the left hand wall portion 13 has a die cut tab 23 which is connected with the wall 13 proper by a score line 24.

Figure 3:
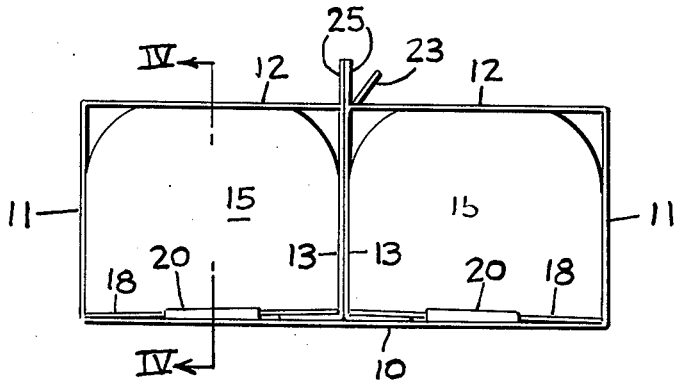
FIG. 3 is an end view taken similarly to FIG. 2 but showing the container set up for use.

When it is desired to set the container up into final form at the point of use beginning with the container in the flat condition shown in FIG. 2, the user presses against the opposite side edges of the flat folded assembly shown in FIG. 2 to bring the several wall portions into the position shown in FIG. 3 to form two rectangular compartments with the two wall portions 13 in abutment with each other. The tab 23 may then be pushed through the opening 22 to secure the medial wall portions 13 against each other and to provide a convenient handle means. The manner in which tab 23 is bent upwardly for this purpose is shown in detail in FIG. 5.

Figure 4:
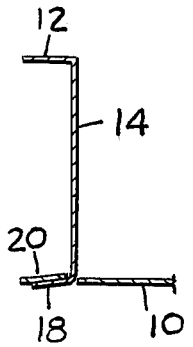
FIG. 4 is a fragmentary cross-sectional view on the line IV—IV of FIG. 3.
Figure 5:
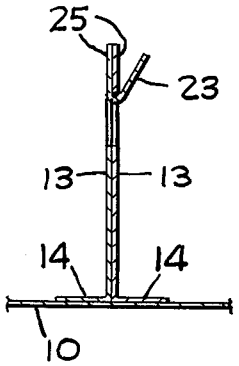
FIG. 5 is a fragmentary cross-sectional view taken transversely through the set up container showing the medial walls thereof and the handle portion.

The side walls 13 are cut to provide handle extensions 25 in cooperation with the opening 22 and the opening formed when tab 23 is folded upwardly as shown in FIG. 5. The tabs 18 of the end wall portions 15 are then bent downwardly, and the end wall portions themselves are likewise bent downwardly about the score line 16, as shown in FIG. 4, and the portions of the tabs 18 between the notches therein are engaged with the die cut tabs 20 of bottom wall 10, as likewise shown in FIG. 4, to provide secure end wall construction for the two longitudinally extending compartments of the receptacle.

It will be noted that when end walls 15 are disposed in finally assembled position the tops of the two compartments are substantially entirely open for placing articles therein and removing them therefrom.

When finally set up, the end walls 15 when placed in final position, maintain the compartments in their desired rectangular cross-sectional condition and the handle tab means 23 maintains the compartments in close side-by-side relation.

A preferred embodiment of the present invention has been described herein and illustrated in the accompanying drawings by way of example. However, it is to be understood that numerous modifications thereof may be made without departing from the broad spirit and scope of the invention as defined in the appended claims.

I claim:

1. A disposable cardboard carrying case formed from a flat generally rectangular blank and having a pair of longitudinally extending side-by-side compartments, said case having a continuous bottom wall, integral side walls extending upwardly from each side edge of said bottom wall, integral top walls extending inwardly from the upper edge of each side wall, and medial walls extending downwardly from the inner longitudinal edge of each top wall said top walls having openings therein for access to said compartments, each medial wall having a terminal portion extending horizonally outwardly from its lower edge, each such terminal portion being adhesively secured to said bottom wall.

2. A carrying case according to claim 1 wherein each of said top walls has portions thereof die cut and scored adjacent to the ends thereof and bent downwardly to form end walls for said compartments and simultaneously form said access openings in said top walls.

3. A carrying case according to claim 2 wherein each of said end walls has a terminal lower end portion thereof bent to extend horizontally outwardly, said bottom wall including die cuts providing flaps for engagement with the terminal lower portions of said end walls.

4. A carrying case according to claim 1 wherein the upper edges of said medial walls include handle openings having interlocking means for securing said medial walls against each other.

* * * * *